US007841267B1

(12) United States Patent
Sanford

(10) Patent No.: US 7,841,267 B1
(45) Date of Patent: Nov. 30, 2010

(54) RECOILLESS LAUNCHING

(75) Inventor: Matthew J. Sanford, Bel Alton, MD (US)

(73) Assignee: The United States of America as represented by the Navy, Washington, DC (US)

( * ) Notice: Subject to any disclaimer, the term of this patent is extended or adjusted under 35 U.S.C. 154(b) by 0 days.

(21) Appl. No.: 12/587,326

(22) Filed: Sep. 22, 2009

Related U.S. Application Data

(62) Division of application No. 11/151,169, filed on Jun. 10, 2005, now Pat. No. 7,624,668.

(51) Int. Cl.
*F41A 1/08* (2006.01)

(52) U.S. Cl. ..... 89/1.701; 89/1.702; 102/437

(58) Field of Classification Search ..... 89/1.7–1.706; 102/437; 42/1.06
See application file for complete search history.

(56) References Cited

U.S. PATENT DOCUMENTS

| | | | | | |
|---|---|---|---|---|---|
| 1,108,715 | A | | 8/1914 | Davis | |
| 1,108,716 | A | | 8/1914 | Davis | |
| 1,108,717 | A | | 8/1914 | Davis | |
| 1,280,579 | A | * | 10/1918 | Stone et al. | 89/1.7 |
| 1,311,021 | A | * | 7/1919 | Spear et al. | 89/1.702 |
| 1,434,044 | A | * | 10/1922 | Cooke | 89/1.702 |
| 2,156,605 | A | | 5/1939 | Prettyman | |
| 2,466,714 | A | | 4/1949 | Kroger et al. | |
| 3,216,323 | A | | 11/1965 | Wengenoth et al. | |
| 3,633,509 | A | * | 1/1972 | Grandy et al. | 102/338 |
| 3,779,130 | A | * | 12/1973 | Schnabele | 89/1.701 |
| 3,796,128 | A | * | 3/1974 | Zeyher | 89/1.701 |
| 4,050,351 | A | * | 9/1977 | Stauff | 89/1.701 |
| 4,132,148 | A | * | 1/1979 | Meistring et al. | 89/1.701 |
| 4,172,420 | A | | 10/1979 | Voss et al. | |
| 4,244,293 | A | | 1/1981 | Grosswendt et al. | |
| 4,484,524 | A | * | 11/1984 | Dawant et al. | 102/437 |
| 4,554,860 | A | * | 11/1985 | Johansson et al. | 89/1.7 |
| 4,574,680 | A | * | 3/1986 | Nicodemus | 89/1.701 |
| 4,676,136 | A | * | 6/1987 | Kalin | 89/1.701 |
| 4,759,430 | A | * | 7/1988 | Kalin | 188/377 |
| 5,099,764 | A | | 3/1992 | Dale et al. | |
| 5,247,889 | A | * | 9/1993 | Luebbers | 102/444 |
| 5,285,713 | A | | 2/1994 | Brage | |
| 5,551,330 | A | * | 9/1996 | Reuche | 89/1.701 |
| 5,668,341 | A | | 9/1997 | Reynolds et al. | |
| 5,975,996 | A | | 11/1999 | Settles | |
| 6,286,408 | B1 | * | 9/2001 | Sanford et al. | 89/1.701 |
| 6,446,535 | B1 | | 9/2002 | Sanford et al. | |
| 7,302,773 | B2 | * | 12/2007 | Rozhkov et al. | 42/2 |
| 2002/0112601 | A1 | * | 8/2002 | Sanford et al. | 89/1.701 |
| 2003/0056639 | A1 | * | 3/2003 | Giza | 89/1.701 |
| 2007/0068374 | A1 | * | 3/2007 | Ostberg et al. | 89/1.701 |

* cited by examiner

*Primary Examiner*—Michelle (Shelley) Clement
(74) *Attorney, Agent, or Firm*—Fredric J. Zimmerman

(57) ABSTRACT

An arrangement for recoilless launch including a non-gaseous reaction mass having a weight in a range of about 25% to about 75% of a weight of a projectile. For the same projectile energy, less propellant is required than a rocket, which minimizes backblast and reduces before-launch weight. The recoilless launching is adapted to shoulder-launched projectiles in a confined space. The reaction mass may be particles associated with a propellant so as to be released concurrently as the propellant turns into gas and accelerated by and with the propellant gas in a nozzle.

9 Claims, 3 Drawing Sheets

| Physics for varying reaction mass weights for 191.4 lb-sec impulse corresponding to projectile of 8.5 lbs with velocity of 725 ft/sec | | |
|---|---|---|
| **Weight of** Reaction Mass **(lb)** | **Required Exit Velocity of** Reaction Mass **(ft/s)** | **Kinetic Energy of** Reaction Mass **(lb-ft)** |
| 1.0 | 6,163 | 589,696 |
| 1.5 | 4,108 | 393,130 |
| 2.0 | 3,081 | 294,848 |
| 2.5 | 2,465 | 235,878 |
| 3.0 | 2,054 | 196,665 |
| 3.5 | 1,761 | 168,484 |
| 4.0 | 1,541 | 147,424 |
| 4.5 | 1,369 | 131,043 |
| 5.0 | 1,233 | 117,939 |
| 5.5 | 1,120 | 107,217 |
| 6.0 | 1,027 | 98,283 |
| 6.5 | 948 | 90,722 |
| 7.0 | 880 | 84,242 |
| 7.5 | 822 | 78,626 |
| 8.0 | 770 | 73,712 |
| 8.5 | 725 | 69,376 |

FIG 1

RECOILLESS LAUNCHING

The present Application is a Divisional Application of U.S. patent application Ser. No. 11/151,169 filed on Jun. 10, 2005 now U.S. Pat. No. 7,624,668

STATEMENT OF GOVERNMENT INTEREST

The invention described herein may be manufactured and used by or for the Government of the United States of America for government purposes without the payment of any royalties thereof.

(1) FIELD OF THE INVENTION

The present invention relates to ordnance, to ammunition and explosives, and to fluid diffusing. More particularly, the invention relates to recoilless guns, rockets, and moveable launchers which utilize a reaction mass and reaction fluid diffusing by a discharge nozzle, and which may utilize a propellant grain with reinforcing, burning control, or pressurization means.

(2) BACKGROUND

In patents and other materials related to the above field of the invention, the terminology is often inconsistent and confusing. Therefore, the present description of the related art will now provide definitions and identifications As used in the present application.

This application involves the motivation of a projectile by pressure moves in an intended direction from a launcher, which may be defined as that which remains when the projectile has departed. The source of pressurized gas may move with the projectile, as in a common firework rocket, or may be with the launcher as in common "firearms," such as, infantry rifles. The portion of a launcher in the direction of projectile movement is commonly termed the forward or muzzle end, and the opposite portion of the launcher is commonly termed the rearward or breech end.

It is apparent that the pressurized gas must be contained in what may be defined as a pressure vessel. In the art of projectile motivation, such a vessel is usually cylindrical and tubular about an axis, which, typically, is aligned with the direction of projectile motion. Such a vessel or which is part of a launcher is commonly referred to as a "barrel" or "tube." These terms are also frequently applied to other, but unpressurized, cylindrical launcher structures for projectile storage and guidance.

A pressurized such vessel may be open at only at a forward end as with the above common firearms or artillery, where the forward end is, of course, closed by the projectile during the time it is being motivated by the pressurized gas. Also, such a pressure vessel may be open only at a rearward end from which the pressurized gas issues, typically as through a nozzle as with the above-mentioned rocket.

However, such a pressure vessel, which is part of a launcher, may be open at both a forward and rearward end. Examples of this are shown in U.S. Pat. Nos. 1,108,715 through 1,108,717 issued to Davis on 25 Aug. 1914 and in U.S. Pat. No. 2,466,714 issued 20 May 1944 to Kroger and Musser. These four patents show a tubular pressure vessel, which is closed forwardly by a projectile during the time the projectile is motivated by the pressurized gas; and, in the Davis patents, the vessel is closed rearwardly at this time by what may be defined as a "reaction mass."

The art of projectile motivation is often concerned, as in the present application, with what is termed "recoilless" launching or "recoilless guns." In this technology, the recoil of a launcher or gun from projectile motivation, as in the above-mentioned firearm or artillery, is minimized, if not obviated, by the movement of a reaction mass in a direction opposite to the direction of projectile motivation.

In the above mentioned and other rockets, launcher recoil is inherently avoided because the motivating gas pressure is only applied within the rocket, which forms the projectile, and not to the launcher. In this case, the pressurized gas itself forms the reaction mass.

Another case of the pressurized gas itself forming the reaction mass is in devices such as that shown in the above U.S. Pat. No. 2,466,714. In these devices, during the time the gas is motivating a projectile, which closes the pressure vessel or barrel forwardly, the gas issues oppositely through a nozzle of the launcher. In these cases, the reaction mass may be defined as a "gaseous reaction mass."

Conversely, a "non-gaseous reaction mass" is utilized in devices such as those shown in the above patents to Davis. In Davis, a pressure vessel or barrel is open at both its forward and rearward ends so that, while the pressurized gas is motivating a projectile forwardly closing the barrel, the gas is also oppositely motivating a non-gaseous reaction mass which closes the barrel rearwardly and is expelled therefrom as the projectile leaves the barrel. Such a reaction mass may be a unitary solid, but is, more often, particulate matter which is dispersed upon leaving the rearward barrel end.

With the above definitions and structures in mind, the related art will now be discussed at greater length and as particularly related to the present application.

In the centuries-old, conventional, tubular, closed-breech gun arrangement, a projectile is launched by being expelled from an open muzzle end by pressurized gas, typically from a material, which decomposes without the presence of oxygen from the air, the opposite, breech end of the tube being closed substantially gas tight, at least during projectile expulsion, and the gas blowing down to ambient pressure through the muzzle after exit of the projectile. In this arrangement, reaction of the gas against the breech end causes the tube to recoil in a direction opposite the direction of projectile expulsion. Further, the tube and breech structure must be relatively heavy to resist the pressure of the gas, which may be very high because closed-breech guns often rely on relatively high projectile velocities for target penetration.

Because of the recoil and weight, such a closed-breech gun, which is capable of firing directly at armored vehicles, bunkers, troop formations, and the like with a projectile of sufficient size for effective attack, cannot be transported or fired by an individual or by the use of unspecialized land, air, or marine vehicles.

Therefore, the above-identified "recoilless" arrangements have been developed for launching suitable projectiles for such attack, these arrangements utilizing a "reaction mass," which is expelled oppositely of the direction of projectile movement to minimize recoil. This mass may be a gas and may also serve directly to propel a projectile. These arrangements have been facilitated by the development during World War II of "shaped charges" which do not rely on projectile velocity for penetration.

A first recoilless arrangement is the subject of the above-identified U.S. Pat. Nos. 1,108,715 through 1,108,717 for, as set forth in claim 5 of the '715 patent, "a gun open at both ends and a projectile and breech block . . . with a propelling charge interposed between, said projectile and said breech block being of approximately the same weight and adapted to fly in opposite directions when the gun is fired . . . . ”

In the ’717 patent, claim 2 defines such a gun having “a projectile . . . , a propelling charge mounted in the rear of said projectile, . . . one or more wads in the rear of said projectile, [and] a counter weight composed of disentegratable material mounted in the rear of said wads or wads”; claim 3 defines the counter weight as being “fine solid particles adapted to be dispersed when the gun is fired”; and the specification states that the counter weight may be “birdshot, fine sand, or the like . . . to avoid injury . . . in rear . . . ”. The “breech block” or “counter weight” serves as the above-identified “reaction mass.”

This first arrangement is sometimes termed a “Davis gun” and is sometimes identified herein for convenience by that name. In this arrangement, later developments have used many different reaction mass materials and configurations including liquids, metal and other powders, gels, plastic flakes, and fiberglass. However and insofar as known to the applicant, all of these “Davis gun” developments have also been characterized by the projectile and reaction mass “being of approximately the same weight.”

A second recoilless arrangement is exemplified by the above-identified U.S. Pat. No. 2,466,714 where column 1 describes the arrangement as one wherein “the forces of rearward reaction that result from projectile discharge are neutralized by forwardly acting counter forces simultaneously set up by the propellant charge’s. combustion.” However, the reaction mass is not distinct from the propellant charge as in the Davis patents, instead “the named recoil neutralization is effected by a rearward escape of generated powder gas through openings or orifices in the gun’s breech.” This arrangement is not claimed in itself, but is stated to be a “recoilless weapon of the named open-breech type” and is identified in some of the claims as “a non-recoil gun”.

To substantially eliminate recoil in the above-identified first and second recoilless arrangements, the momentum magnitude, or product of mass and velocity, of the reaction mass should approximate that of the projectile.

In the first arrangement, this occurs because the reaction and projectile masses are approximately the same and are subjected to the same gas pressures so that these masses have approximately equal kinetic energy.

In the second arrangement, however, the mass of the propellant is substantially less than the mass of the projectile so that the velocity of the reaction gas derived from the propellant must be substantially higher than the velocity of the projectile—a condition obtained by suitable nozzle configuration of the orifice or orifices providing the rearward escape of propellant gas. Since kinetic energy is a function of mass and velocity squared, this condition results in the reaction propellant gas having substantially more energy than the projectile.

It is apparent that both of the above-identified recoilless arrangements may be termed “open-breech” in contrast to the “closed-breech gun arrangement.”

All three of these gun arrangements are characterized by a tube which remains stationary while the propelling gas is generated within it to expel the projectile, the pressurized propellant gas subsequently blowing down to ambient pressure though the muzzle opening and any breech opening. The tube, therefore, must withstand the maximum pressure of this gas, even though, in many such arrangements, the propellant is disposed in a cartridge case for convenience in loading, sealing of the pressurized gas, and the like, this case being in a fixed position in relation to the tube during expulsion of the projectile and reaction mass.

In the above described open-breech arrangements, as well as in the closed-breech arrangement, the tube serves not only to propel the projectile toward the target, but, conventionally, also serves to direct the projectile toward the target.

Such a tube may have spiral internal grooves or “rifling” for projectile stabilization. However, weapons having a tube are frequently termed “rifles” although the tube is “smooth bore” and the projectile is otherwise stabilized, as by fins. In any event, the principles of the present invention are not restricted in their application to any particular tubular or other structure.

For the purposes of the present application, propellants are, typically, comparatively solid materials which, as before stated, decompose without the presence of oxygen from the air although the present invention in its broadest aspects is not so limited. Such materials are sometimes termed “energetic materials” and include not only “propellants”, where the decomposition is relatively slow to provide a desired pressure consistent with any enclosing structure, but what may be termed “explosives” where destructive effect is desired. However, this distinction, as with others in the field of the present invention, is not consistently applied in descriptions of the prior art.

Similarly, although such propellants, as the term is used herein, decompose, the decomposition is often referred to, in the field of the present invention, as a “burn” or “combustion”, so as to “fire” a weapon or “fire” a projectile therefrom after the propellant is “ignited.” This terminology is sometimes utilized in the present application for consistency with related art terminology or common usage.

A further aspect of propellants is that it is desirable that they be “insensitive munitions,” which are energetic materials which are less likely than historical such materials to be detonated or ignited by mechanical shock, “cookoff”—slow or fast application of heat, impact, and electrical discharge.

For a perceived embodiment of the present invention as applied to a weapon having a tube extending over an operator’s shoulder and fired therefrom, the propellant may be a conventional material utilizing nitrocellulose with or without nitroglycerine and suitable plasticizers and combustion control additives.

It is well-known to add, to such propellant material, particulate metals, such as aluminum and boron, with suitable oxidizers, to increase energy density. However, the amount of metal added by weight has been the same order of magnitude as the other ingredients. It is also known to add lead and copper salts in relatively small amounts for combustion control. Such use of metals or compounds in a propellant may be consistent with the present invention its broader aspects.

However, insofar as known to the applicant, it is not known to associate inert materials with such a propellant, particularly inert metals in a quantity by weight equal to or much greater than the weight of the energetic material itself.

Another aspect of the above-identified conventional propellants is that they typically require relatively high pressures, such as tens of thousand of pounds per square inch, to give the usual, desired rate of decomposition. As a result, when these materials are used to provide propellant gas at a lower pressure, such as a few thousand pounds per, square inch, it is known to use them in a “high-low chamber.” In this arrangement, the propellant is disposed and ignited in an enclosure where the necessary high pressure for decomposition is maintained, this enclosure communicating, as by appropriately sized orifices through which the high pressure gas-blows down, with another region at the lower, utilization pressure.

A third recoilless arrangement is a “rocket” which, for the purposes of the present application, is a vehicle propelled by reaction to the expulsion of material from the vehicle in a direction opposite the desired direction of vehicle movement, the expelled material being carried with the vehicle before expulsion. Typically, at expulsion, this material is gaseous, being generated and pressurized for expulsion by combustion or decomposition without the use of oxygen from the air in a chamber which moves with the vehicle, the gaseous material being accelerated by blowing down from the chamber through a suitable nozzle. However, it is known to propel rockets by expulsion of non-gaseous materials and certain aspects of the present invention may be effective therewith.

Since, in a rocket, the propulsion forces react internally on the vehicle and oppositely on the expelled material, there is no recoil of a launching structure for the vehicle although this structure may serve, variously, to transport the vehicle, to support it during its beginning movement, and to direct it toward a target.

In weapons using a rocket launched from a tube that, as previously described, extends over an operator's shoulder, the rocket is typically powered by propellants which are like those described above in utilizing nitrocellulose with or without nitroglycerine and suitable plasticizers and combustion control additives. In solid propellants for use with rockets of all kinds and sizes, insofar as known to the applicant, metals have been incorporated only to increase energy density and for combustion control.

Since a rocket is propelled by reaction on the expelled material, it can be seen that this material may be termed a "reaction mass" and corresponds to a reaction mass employed with the above-identified first and second recoilless arrangements where the propelling gas is generated within an element which remains stationary while the propelling gas is generated within it, this being in contrast to a rocket where propelling gas is generated in an element moving with the propelled vehicle.

In conventional rockets for shoulder fired weapons and the like, the gaseous reaction mass is generated from propellant having a mass substantially less than the mass of the balance of a projectile propelled by and including such a rocket. Therefore and as with the second above-identified recoilless arrangement, the velocity of the reaction gas derived from the propellant must be substantially higher than the velocity of the entire projectile. As a result and as with this second arrangement, substantially more energy is provided to the reaction propellant gas than to the projectile.

In many rocket propelled devices, the reaction gas is generated for a relatively long time after the device has left a launcher, the device then being unguided, as with common firework rockets, or guided by elaborate systems as when launching space vehicles. However, in weapons for carrying and shoulder firing by an individual, the projectile is launched from within a tube; and, for practical manipulation, the weapon should have an overall length when ready to fire of not over about 60 inches (1.5 meters) and, for transportation, be provided in sections about half that length. In shoulder fired recoilless weapons, as discussed below at greater length, the projectile is commonly unguided except by directing the tube toward a desired target; and, when firing the tube extends before and behind the operator. Therefore, with shoulder fired weapons using a rocket, the period of gas generation must end before the projectile has left the tube to prevent injury to the operator, or at least, to avoid disconcerting future operation.

A serious deficiency of recoilless devices, such as the three arrangements described above, is "backblast" which is the expulsion of reaction gas, any other reaction mass, packaging particles, and the like oppositely of the projectile. This deficiency, which it is an object of the present invention to alleviate, will be discussed extensively below. However, it may be mentioned that this backblast is dangerous in itself—as for a distance 15 to 75 yards or meters behind a shoulder fired recoilless weapon even with the comparatively small amount of propellant used therein. In these weapons, this problem is exacerbated by the above-mentioned short period of propellant combustion and gas generation which requires relatively high pressures to impart desired projectile velocity. In the open, such backblast attracts enemy attention by noise, smoke and stirred up dust and, in an enclosure, creates pressures injurious to the weapon operator and others in the enclosure.

At this point, there will be briefly discussed nozzles or orifices which are utilized to impart a desired velocity to pressurized gas blowing down to a lower pressure. Such nozzles are used for the reaction gas from rockets and the above-identified second, fixed tube recoilless arrangement as well as in turbines and other devices. In all of these applications, the nozzle has a converging portion where the gas is accelerating toward sonic velocity and then, if a higher velocity is desired, a portion diverging downstream from the converging portion.

Nozzles are, correspondingly, used in abrasive blast cleaning to accelerate gas containing particulate material and impart a desired velocity to the particles. However, the particles do not accelerate as fast as the gas, so that it is known to utilize nozzles having relatively straight portions downstream of their converging portion where the gas velocity is maintained so that the particles can "catch up". The related art includes various nozzle configurations for this purpose, a particularly effective such configuration and discussion of the related art being set forth in U.S. Pat. No. 5,975,996 issued to Settles on 2 Nov. 1999.

The related art, as found in weapons adapted to be carried and fired by an individual, will now be described in greater detail.

Such recoilless weapons were found to be an effective tool for ground troops during WWII and have been widely used since then. For the purposes of the present application, such a recoilless weapon typically consists of a launcher loaded with a rocket projectile which includes a warhead and a rocket motor. The warhead is the militarily effective portion of the projectile such as destructive explosive. The rocket motor is, typically, of tubular configuration and includes the above-identified chamber and nozzle, the chamber containing a solid propellant of the kind described above and confining the pressurized gases which are generated therefrom and then issue through the nozzle. The motor, typically, remains attached after gas generation so that the projected mass, or projectile for the purposes of the present application, includes the warhead and the motor less the mass of the ejected propellant and any packaging or other materials associated therewith, such other materials being employed in one aspect of the present invention. The projectile may include guidance equipment as with rocket projectiles of other types, but this is typically not provided in shoulder lunched weapons for use against ground targets.

The rocket motor provides thrust to propel the warhead, and does not impart significant recoil forces to the launcher or operator which allows such a warhead to be much heavier and larger than a small arms bullet. An individual can thus launch what is essentially a large, fast moving grenade without associated heavy equipment. Also, these recoilless weapons typically employ shaped charge warheads. As a result, an individual can carry enough equipment to engage a tank. For the purposes of the present application, a launcher is what remains with the operator after the projectile has departed. Such a launcher may be reusable, may include an attachable and subsequently discardable encasement for with the projectile, or may be combined with the warhead and rocket motor in a disposable, single shot device. The principles of the present invention are variously adaptable to all variations of recoilless and rocket devices mentioned in this and the preceding paragraph.

As mentioned above, in conventional recoilless weapons, rocket motors emit a considerable backblast to the rear of the operator. This backblast can be lethal to personnel exposed to it, and the operator absorbs a considerable level of noise and overpressure when firing the recoilless weapon. This backblast precludes firing conventional rocket powered recoilless weapons from within a structure, since the back blast would be contained and reflected within the structure, causing damage to it and injury to the operator.

In recent times, the urban environment is more and more frequently the site of combat operations, and the effectiveness of recoilless weapons using thermobaric warheads on structures has made these weapons an important tool in the urban environment. During urban combat it is often desirable to fight from within structures or other confined spaces in order to limit exposure to hostile fire; however, a recoilless weapon operator is highly exposed and subsequently easily located upon leaving cover to fire a very loud device with a radiant back blast.

One arrangement to minimize backblast when firing a rocket projectile from within a structure is to propel the projectile out of the structure with a small propellant charge and at a very low velocity, and then utilize a larger propellant charge when the projectile is clear of the structure. However, with this arrangement, when the larger charge ignites, the projectile is no longer guided by the launcher, which was used to aim the projectile. As a result, this arrangement has very poor accuracy unless an additional, active form of guidance is provided. However, this kind of guidance typically increases the cost of each projectile by at least ten times, a significant disadvantage in weapons intended for use by an individual where simplicity and low cost are desirable.

Another arrangement for firing a recoilless weapon from within a confined space is the above-identified first or Davis recoilless arrangement in which a propelling charge is disposed between a projectile and a reaction mass, so that, when fired, the projectile is propelled in one direction and the reaction mass is propelled in the opposite direction. This arrangement allows a operator to fire from within an enclosed space primarily because it uses approximately one-tenth the amount of propellant that an equivalent rocket motor would use for the same warhead weight and velocity so that there is less excess energy released into the space.

For the same warhead mass and velocity, less propellant is needed in the Davis arrangement than in a rocket motor for several reasons. First, it is more efficient to convert stored energy from the compressed gas state into kinetic energy using a piston-piston arrangement than in a rocket motor, if the pistons—the projectile and the reaction mass—have approximately equal weight, and thus are provided with equivalent total impulse and energy. In the rocket, however and as explained above, the exiting propellant gasses weigh much less than the rest of the projectile, including the warhead, and so leave at a much higher velocity than the projectile velocity so that the projectile and gasses will have equivalent impulse. As a result, the projectile and gases have a vastly different kinetic energy since this is a function of mass times velocity squared. The majority of the available energy thus ends up with the gases and is consequently dumped into an enclosure when in a rocket is fired therefrom.

A serious disadvantage of the Davis arrangement is that, because of the weight of the non-gaseous reaction mass, the overall weight is significantly more than with a conventional rocket propelled system with as equivalent warhead. Another serious disadvantage is that the reaction mass is a hazard after it is ejected and before it disperses and slows down, this disadvantage being recognized in the above-mentioned U.S. Pat. No. 1,108,717 and since then by the use of the above-mentioned variety of reaction mass materials in an effort to reduce this hazard. An additional disadvantage, which is discussed further below, is increased tube length over an equivalent rocket arrangement. In a particular application, these disadvantages can be lessened, but at a sacrifice in effectiveness, by a reduction in warhead weight or velocity.

An alleviation of the excessive weight disadvantage of the Davis arrangement in relation to rocket propulsion for equivalent warhead mass and velocity would be, in accordance with one aspect of the present invention, to use a lighter reaction mass and send it out faster with more propellant. However and as before stated, the projectile and reaction mass have, in prior art arrangements using the Davis reaction mass principle, always had the projectile and reaction mass "of approximately the same weight".

At this point, reference is made to four United States patents: U.S. Pat. No. 2,156,606 issued to Prettyman-on 2 May 1939; U.S. Pat. No. 3,216,323 issued to Wengenoth et al. on 9 Nov. 1965; U.S. Pat. No. 4,172,420 issued to Voss et al. on 30 October; and U.S. Pat. No. 5,285,713 issued to Brage on 15 Feb. 1994. These patents appear to show recoilless launching structures having similarities to the above-identified first, or Davis, arrangement which is characterized by a "non-gaseous reaction mass." These patents disclose counter masses, which may be of less weight than the projectiles unlike the first arrangement where the projectile and reaction mass are "of approximately the same weight". However, it is apparent that the structures disclosed in these four patents are not functionally equivalent to a "non-gaseous reaction mass."

U.S. Pat. No. 2,156,605 shows "divided counter-charges and counter-masses . . . for neutralizing the recoil of the gun . . . ", and states on page 2:

> "It is well-known that by balancing equal weights . . . , such balancing will result in no motion of the tube containing the explosion. The relatively small amount of sand used successfully as a counter-recoil is due to the flowing of the sand [counter-balance] under the explosion pressure so as to expand against the walls of the tube and momentarily prevent the egress of gases past the sand and so hold up the internal pressure until it has performed its useful work in imparting the necessary velocity to the [projectile of] lead pellets. The load used in the tube for the friction counter-balance is two and one-half pounds.
>
> If the load used is based on the counter weight balance, the weight is four pounds two ounces, an increase of sixty percent in each shot.
>
> "The sand . . . comes in contact with the walls of the tube and exerts a counter-frictional effect in obtaining non-recoil of the tube."

This patent thus discloses the reduction of recoil by a frictional effect.

The other three patents are believed to disclose variations of the above-identified second recoilless arrangement characterized by a "gaseous reaction mass". U.S. Pat. No. 3,216,323 states in columns 1 and 2:

> "[The dust or powder] tamping body is chosen as large as possible compared to the weight of the projectile. It should preferably be of 20 to 25 percentage of the weight of the projectile . . . . The tamping body . . . consists of one or more channels through which . . . part of the propellant gas may escape rearwardly before the tamping body has left the tube."

Thus, the tamping body is not provided to function as a non-gaseous reaction mass but to serve as an orifice for an above-identified high-low chamber.

The structure of U.S. Pat. No. 4,172,420 functions similarly since it is stated in column 4:

"The tamp is suitably provided with a central continuous bore or recess in order to obtain a reduction of the gas pressure peaks . . . ", and the tamp 7 with central bore is disposed oppositely of a chamber 6 from a "powder portion" 5.

U.S. Pat. No. 5,285,713 discloses, as stated in claim 1, a countermass body "comprised of a weakly bonded powder mass and having at least one gas throughflow passage . . . having the form of a rearwardly widening nozzle." The passage is deformed by gas flow as shown in FIGS. 5*a* through 5*c*, so that as stated in column 5:

"The deformability of the countermass body, in combination with the configuration of the gas throughflow passage, enables a relatively high gas pressure to be maintained in the barrel over a longer time period than when using a conventional countermass. The countermass can be said to function as an overpressure valve which functions to reduce the brief maximum pressure and to extend the duration of pressure in the barrel."

The counter mass is thus not provided to function as a non-gaseous reaction mass but to serve as an orifice for pressure control, and no relative masses of the counter mass and projectile are set forth.

In connection with FIG. 5*a*, it is noted that: "Small parts of the counter mass material are constantly dispersed in the exiting gas and are accelerated to high velocities." The counter mass is distinct from the propellant charge, and in column 4 it is stated that the counter mass may be "heavy materials containing tungsten, copper, iron, etc." and that that "The grain size should be smaller than 2 mm in diameter so that the powder will be retarded rapidly in the ambient air . . . and greater than 0.05 mm in order for the material to disintegrate."

Related art arrangements using the first recoilless, or Davis reaction mass principle, always had the projectile and reaction mass "of approximately the same weight" potentially due to perceived problems in adapting a conventional Davis arrangement to achieve sufficient thrust with a lighter reaction mass. These problems include limitations on barrel length of the reaction mass launching section, limitations on internal pressure due to weight constraints, limitations on dumping high pressure residual gasses within a structure, difficulty in accelerating the balance of the reaction mass once part of it has exited its launching section, and difficulty in dispersing the reaction mass as it exits its launching section. These problems will now be discussed at greater length and in relation to use of the Davis arrangement in a confined space since this is related to other aspects of the present invention. In regard to this discussion, it should be considered that shorter, lighter warheads have poor penetrating capability, less accuracy, and less range than longer and heavier warheads at the same initial velocity.

For comparison with the Davis arrangement as identified above, a "fourth recoilless arrangement" utilizes a pressure vessel moving with the propelled vehicle and open, in some way, at a rearward end from which a non-gaseous reaction mass is expelled. Accordingly, the reaction mass material is carried with the vehicle before expulsion. As with the third recoilless arrangement, or rocket, the propulsion forces react internally on the vehicle and oppositely on the expelled material, so there is no recoil of a launching structure for the vehicle. The configuration and functions of such a launching structure may correspond to those of rocket launching structures.

A wide variety of weapons utilizing this fourth arrangement have been proposed, but none have reached the widespread operational deployment of the other launching arrangements identified above. In these fourth arrangement weapons, what may be called the "propulsion structure" and is exclusive of the warhead or other useful load, is relatively complex and includes not only the pressure vessel, propellant, and reaction mass material, but includes a variety of associated elements for containing other elements and establishing a sequence of operation.

However, these fourth recoilless arrangement are intended to offer substantial back-blast reduction, minimal danger from rearwardly expelled reaction mass and other materials, and even silent launching. Examples are shown in U.S. Pat. No. 4,244,293 issued to Grosswendt et al. on 13 Jan. 1981; U.S. Pat. No. 5,099,764 issued to Dale et al. on 31 Mar. 1992; and U.S. Pat. No. 6,446,535 issued on 10 Sep. 2002 to Sanford, et al.

U.S. Pat. No. 4,244,293 discloses a warhead with a rearwardly extending tube which contains a propulsive charge disposed between the warhead and a sabot carrying a frangible reaction mass. The rear end of the tube retains the rearwardly moving sabot while passing the disintegrating mass as the projectile is propelled forwardly. Propulsion gases within the tube are temporarily retained by heat-destructible plugs.

U.S. Pat. No. 5,099,764 discloses the use of propellant gases in a tube attached rearwardly to a warhead to urge a piston in the tube against a liquid therein and expel the liquid into the atmosphere from the tube through nozzles rearwardly thereof. The momentum of the expelled fluid results in the propulsion of the warhead and tube so that the overall structure functions something like a rocket, but has a liquid reaction mass. When the piston reaches the nozzles, it closes them so the gases are retained in the tube.

In U.S. Pat. No. 6,446,535, of which the present inventor is a co-inventor, propellant gases in a first tube attached rearwardly to a warhead act against a piston and attached second tube, which extends rearwardly from the piston and initially is disposed therewith in the first tube, to urge the piston and second tube rearwardly. The second tube contains a dispersible counter mass of dimensionally stable elements such as disks of plastic material. The momentum of the piston, second tube, and counter mass results in propulsion of the warhead and first tube. When the piston reaches the rear of the first tube, the piston and second tube become attached thereto and the inertia of the counter mass carries it rearwardly from the second tube while the piston and second tube, which has been relieved of the counter mass, move with the warhead and first tube as a combined projectile so that the overall structure functions something like a rocket, but has a reaction mass of substantially solid elements.

At this point, there is mentioned a "sixth launching arrangement" for a recoiling, closed-breech device. This sixth arrangement is related to the fourth recoilless arrangement in also having a gas containing propulsion structure moving with a warhead to provide silent launching. An example is disclosed in U.S. Pat. No. 5,668,341 issued on 16 Sep. 1997 to Reynolds et al.

To return to perceived problems in adapting the above-identified first recoilless arrangement—and also the fourth such arrangement—to achieve sufficient thrust with a lighter reaction mass. First, the length of the launching tube or barrel is a critical factor in shoulder launched weapons, as the barrel must extend beyond the warhead for guidance while the overall length, as discussed above, is limited to what is practical for an individual to transport. The barrel length limitation is exacerbated by the fact that, when the warhead and reaction mass move in opposite directions and the barrel is attached to the warhead in the fourth arrangement, the barrel length gets used up twice as quickly. However, if the barrel is not attached to the warhead, the length of the warhead is limited. In either case, the volume of the propellant decomposition or combustion region opens up very quickly because both the reaction mass and the warhead are opening it up. And, if the reaction mass weighs less than the warhead, the combustion region opens up even more quickly.

Second, the strength of the barrel or pressure vessel used to launch the warhead and reaction mass limits the pressure that can be contained, which limits how fast the warhead and reaction mass can go. If the barrel is made stronger, it becomes heavier and more expensive. If the pressure vessel is attached to the warhead, it is additional weight to be accelerated, but if it is not attached to the warhead, the weight of the launcher is increased.

Third, the first recoilless or Davis arrangement necessitates that the warhead and reaction mass move apart, rapidly opening the volume containing the pressurized gasses. If the propellant is burned quickly to compensate for this, then it builds great much pressure and runs into the barrel strength limitation. If more, slower burning propellant is added to compensate for the rapidly opening volume, than the length of the barrel capable of containing high pressure must be longer, and there are more residual gasses released into the environment, which further diminishes the confined space capability of the weapon.

An example of recoilless launching is one version of the Shoulder-launched Multipurpose Assault Weapon (SMAW) which is an 83 mm diameter rocket deployed by the United States Marine Corps. The weight of the projectile, that is, the warhead and empty rocket motor, is 8.5 lbs. The propellant weight is about 1.0 lb, and the ready-to-fire weight of the projectile and launcher is 29.5 lbs. The rocket travels about 30 inches before leaving the launcher; and, as mentioned above for shoulder launched weapons, the propellant burns completely in this distance requiring a high propellant gas pressure and considerable backblast.

SUMMARY OF THE INVENTION

First Aspect

A first aspect of the present invention involves the use, in recoilless launching, of a non-gaseous reaction mass having a weight substantially less than the weight of a launched projectile. This is in contrast to the prior art where the reaction mass is either gaseous, as in a rocket, or has a weight about equal to the weight of the projectile. As a result and for the same projectile energy, this aspect of the present invention requires less propellant than a rocket so that backblast is minimized while the before-launch weight is less than with a reaction mass having about the weight of the projectile. Recoilless launching in accordance with the present invention is thus particularly adapted to shoulder-launching and to use in a confined space.

This aspect of the invention may be practiced by the use of a pressure vessel which is stationary as a portion of a launcher or which moves with a projectile as a portion thereof. In either embodiment, the reaction mass may be distinct from any propellant and is expelled rearwardly from the pressure vessel. Any suitable reaction mass might be used, including a solid, but generally particulate material would be used to minimize danger to persons and structure rearwardly of the launcher.

FIG. 1 is a table showing the physics of this first aspect for a given impulse, which is 191.4 lb-sec and corresponds to the above-identified SMAW rocket weapon which launches a projectile with a weight of 8.5 lbs at 725 Ft/sec for a kinetic energy of 69,376 ft-lbs. The first table entry is for a reaction mass of 1.0 lb, as where 1.0 lb of propellant reacts into a gaseous reaction mass and no non-gaseous reaction mass is used. The last entry corresponds to the above-identified first, or Davis, recoilless arrangement with an 8.5 lb non-gaseous reaction mass equal to the projectile weight, this mass being used with a propellant weight of 0.1 lb. The intermediate entries are for increasing reaction masses between about 1.0 and about 8.5 lbs. For each reaction mass, there is shown its required velocity for reaction mass to equal the projectile momentum. For this velocity the resulting kinetic energy of the reaction mass is shown.

The high kinetic reaction mass energy, with resulting high backblast, is apparent for the first entry; while the last entry shows the high reaction mass weight which would be undesirable for carrying by an individual.

In a corresponding practice of the first aspect of the present invention, a reaction mass of 3.7 lb appears desirable and would require about 0.3 lb of propellant which would give a tolerable backblast for a shoulder-launched weapon for use in a confined space without increasing the carry weight unduly. For comparison, it is believed that this would provide, a ready-to-fire device having a carry weight of about 15 lbs overall which would, as will be discussed later, be interchangeable with and comparable in effect to the SMAW encased, pure rocket device without the above-described deficiencies of the pure rocket or Davis arrangements.

However, inspection of the table shows that practice of the present invention with a reaction mass having a weight in the range of about one-fourth to three-fourths of the projectile weight may be quite effective, particularly for recoilless launching in other fields than shoulder launched weapons such as, without limitation, artillery, line throwing, and aircraft takeoff assist.

Second Aspect

In a second aspect of the present invention, such a non-gaseous reaction mass of inert, particulate material is associated uniformly with a propellant, which may be a conventional single or double base propellant. The particles of the material are released concurrently with the progressive reaction of the propellant into pressurized propellant gas in a pressure vessel.

The association of the particles with the propellant may be made by coating the particles onto sticks or sheets of the propellant or, preferably, by dispersing the particles into the propellant when in a liquid form before the propellant solidifies.

Particulate tungsten metal is believed to be highly effective for this purpose, and the proportion by weight of particulate tungsten material in a composition of propellant and reaction mass may be the range of about 50% to about 90%. As a result of this high proportion of thermally conducting and inert material, the composition provides an insensitive munition.

However, the relatively high thermal conductivity and relatively low specific heat of this inert material may allow intended ignition and normal reaction speed despite this high proportion of inert material. The reaction speed may be increased, if desired, by use of the composition with a pressure vessel with a high-low chamber. A perforated barrier, as in a high-low chamber, may also serve to support the dense propellant composition during reaction and projectile acceleration.

In this second aspect, the pressure vessel is provided with a nozzle for acceleration of the pressurized gas, and the particulate material released at the same time is accelerated in the nozzle by the pressurized gas so that the inert material functions as a reaction mass for recoilless launching of the projectile.

Third Aspect

In a third aspect of the present invention, the above-identified first and second aspects are combined by the use of the inert particulate reaction mass and propellant composition in a pressure vessel which, as with a rocket, moves with a projectile. The reaction mass is provided in an amount such that the weight of the inert material is substantially less than the weight of the launched projectile, and as mentioned above, may preferably have a weight in a range of about one-fourth to three-fourths of the projectile weight. In this aspect of the invention, the particles are accelerated in the propellant gas flow to supersonic speeds, and exit the nozzle with an equivalent total impulse as would be imparted by a conventional rocket motor as discussed above in connection with FIG. 1.

For complete acceleration of the particles, the nozzle may be relatively elongated in relation to conventional rocket nozzles—for example, as set forth in the above-identified U.S. Pat. No. 5,975,996. However, if the particles have a size of not more than about 20 microns, the propellant gas and particle mixture may not require such an elongated nozzle.

A relatively large particle size may be desirable to limit the quantity of airborne particles in a confined space in which the invention is practiced.

It has been found that, with a 50% mass ratio of particulate tungsten metal in a diameter range of 3 to 20 microns in a conventional double base propellant, the tungsten does not ignite and the propellant burns properly. Also, the smaller tungsten particles sizes may provide a more insensitive munition than particles having a size between 75 and 150 micron diameter.

For nozzles used in the practice of the present invention, it may be desirable to under-expand the propellant gas so that the residual pressure helps to disperse the reaction mass particles after exit from the nozzle.

In the third aspect of the invention, the reduced backblast, which is due to reduced propellant quantity in relation to a rocket weapon such as the above-identified SMAW, is further reduced, particularly in regard to noise, because the energy put into accelerating the reaction mass will not be released acoustically into a confining space. Further, the backblast will be dampened by the dense particles in the turbulent propellant gas. Additionally, this gas will exit the nozzle at a slower velocity than in a conventional rocket motor because the gas will have transferred much of its kinetic energy to the reaction mass.

It is an object of the present invention to provide recoilless launching where the launching causes minimal backblast of flash, particles, smoke, sound, and pressure.

A specific object is to provide such launching of projectiles from within a confined space.

A further object is to provide such recoilless launching with a convenient weight and length of projectile and launcher, particularly for launching by an individual and from the shoulder.

Another object is to provide such recoilless launching wherein a reaction mass is dispersed without injury to persons and structures.

A further object is to provide recoilless launching in accordance with the above objects while providing effective weight and velocity for a launched projectile.

Still another object is to provide a device meeting the above objects that can be substituted for an existing rocket motor that is deficient in regard to these objects.

Yet another object is to provide, in accordance with the above objects, fully effective recoilless launching which may utilize insensitive munitions and result in minimal environmental damage.

BRIEF DESCRIPTION OF THE DRAWINGS

These and other objects, advantages, and novel features of the present invention will be apparent from the following detailed description when considered with the accompanying drawings wherein:

FIG. 1 is a table showing the physics with varying reaction mass weights for a given impulse, which is 191.4 lb-sec and corresponds to the above-identified SMAW rocket weapon which launches a projectile with a weight of 8.5 lbs at 725 Ft/sec for a kinetic energy of 69,376 ft-lbs;

DETAILED DESCRIPTION OF THE INVENTION

FIGS. 2 through 6 depict a variety of embodiments of the aspects of the present invention. In these figures, structures subjected to pressure are indicated by conventional section lines and other structures are indicated by solid lines. In the depicted embodiments, regions containing propellant are indicated by dots; regions containing a reaction mass in accordance with the present invention are indicated by cross section lines; and regions containing a combined propellant and reaction mass composition, in accordance with one aspect of the present invention, are indicated by cross section lines filled in with dots.

Figure 4:
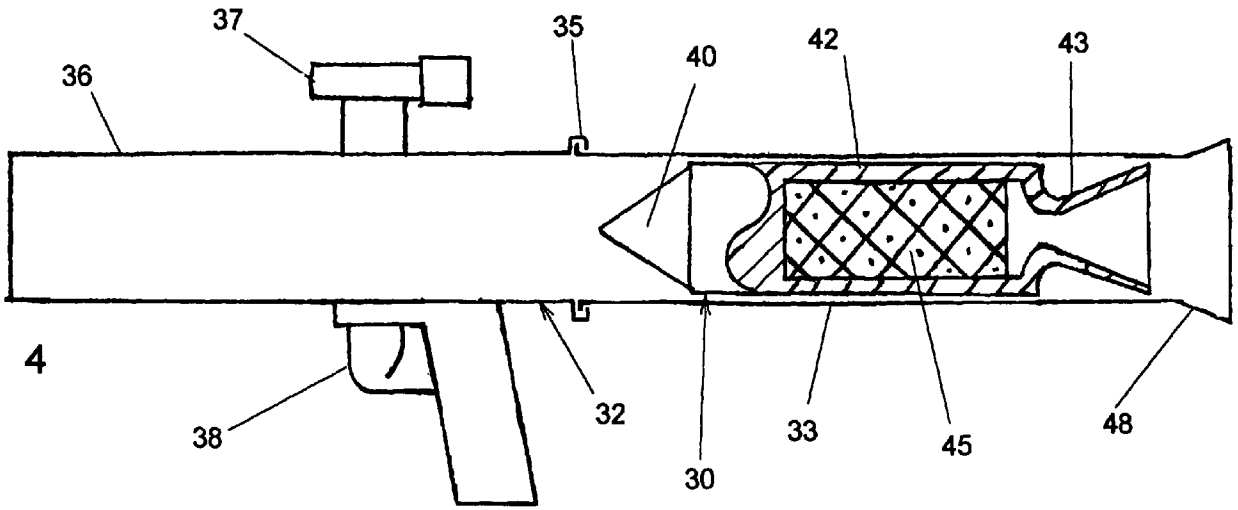
FIG. 4 is a diagram of an embodiment of the invention for shoulder launching.
Figure 5:
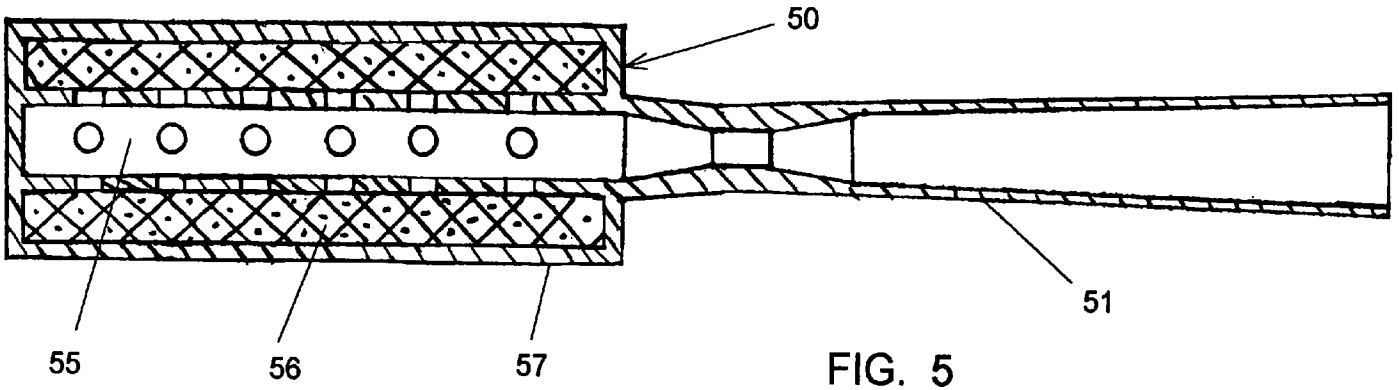
FIG. 5 is a diagram of an embodiment of the invention, approximately to scale, using a high-low chamber and an extended nozzle.
Figure 6:
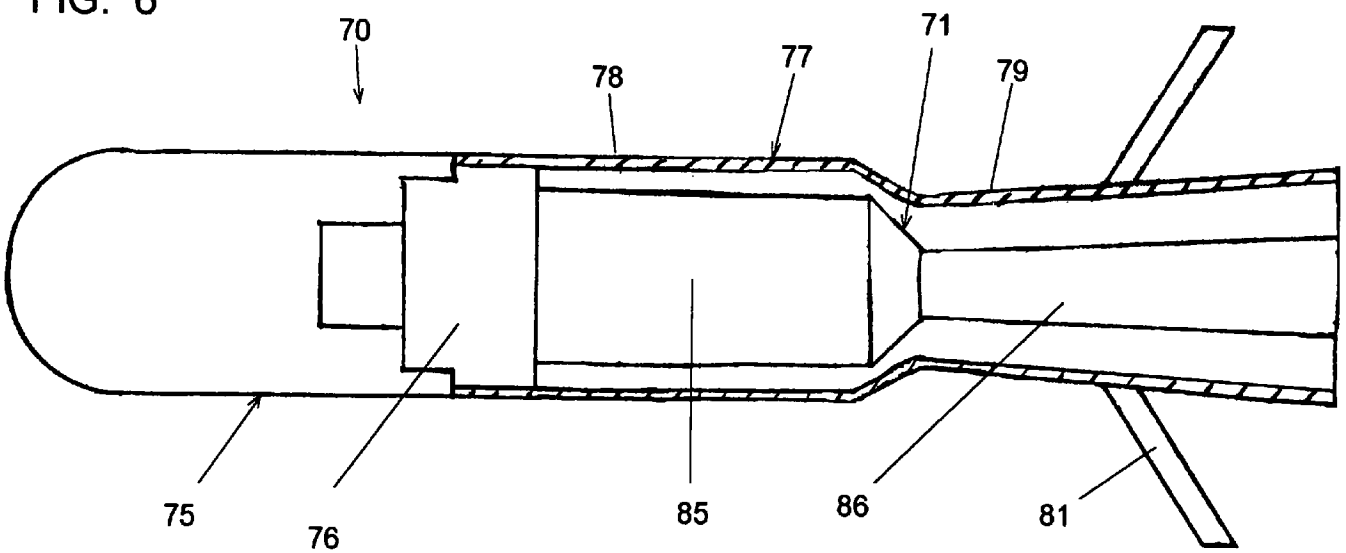
FIG. 6 is a diagram, approximately to scale, of an embodiment of the invention in a conventional rocket projectile case.

These figures, except for FIGS. 5 and 6, are not to scale. However, FIGS. 2 through 6 but may be considered as showing recoilless launching with a reaction mass of in a range of about 25% to about 75% of the weight of a projectile, the later including a warhead or other payload and, in FIGS. 3, through 6, a pressure vessel with nozzle and propellant retaining elements which move with the payload. Also, but only for exposition and not by way of limitation, FIGS. 2 through 6 may be considered in connection with launching, as with the above-identified SMAW weapon, of a projectile of about 8.5 lbs. However, the represented launching is carried out, in accordance with one aspect of the present invention, with the above-mentioned reaction mass of about 3.7 lbs and about 0.3 lb of conventional single or double base propellant. The propellant and reaction mass are depicted as separated in FIGS. 2 and 3, and as combined in accordance with a further aspect of the invention in FIGS. 4 through 6.

Figure 2:
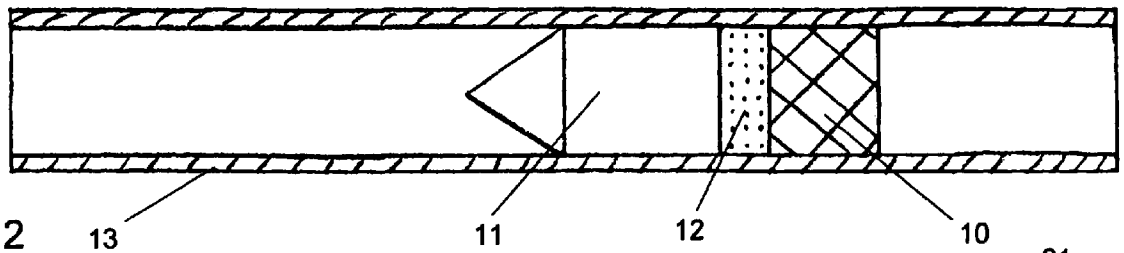
FIG. 2 is a diagram of an embodiment of the present invention using a stationary pressure vessel.

FIG. 2 shows an embodiment of the present invention related to the above-defined "first recoilless arrangement", but distinguished therefrom by the reaction mass 10 having a weight substantially less than the weight of the projectile 11, unlike that arrangement which is characterized by "said projectile and said breech block being of approximately the same weight."

Reaction mass 10 and projectile 11 have a quantity of propellant 12 disposed between them, and these elements are disposed in a tubular pressure vessel 13 so that pressurized gas from the propellant motivates the reaction mass and projectile oppositely from the pressure vessel with the reaction mass having a higher velocity so that the momentum magnitude of the reaction mass is about equal to the momentum magnitude of the projectile which is launched. As a result, the overall weight of the FIG. 2 embodiment is less than that of the first recoilless arrangement while the amount of propellant is less than in the above-identified "third recoilless arrangement" or "rocket" so that the backblast is less than with a rocket.

It may be advantageous to provide an embodiment like that of FIG. 2 with a reaction mass of particulate or other material to reduce danger from this mass rearwardly of the pressure vessel, and this vessel may be provided with any suitable rifling, aiming devices, or mounting.

Figure 3:
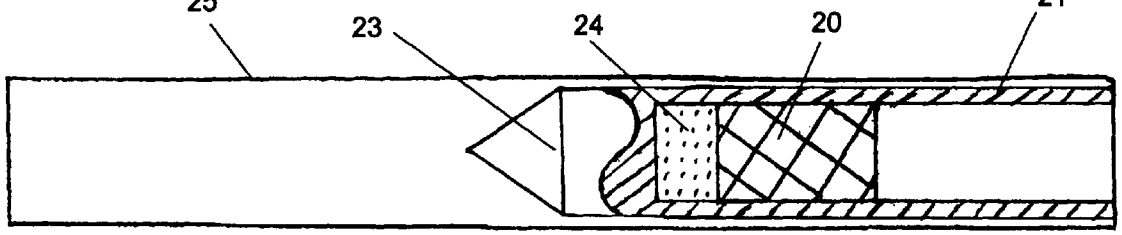
FIG. 3 is a diagram of an embodiment of the invention using a moving pressure vessel.

FIG. 3 shows an embodiment of the present invention where the reaction mass 20 is moveably disposed in a traveling pressure vessel 21, which is a rearward portion of a projectile 22 having a warhead or other payload 23. A quantity of propellant 24 is disposed in the pressure vessel so that pressurized gas from the propellant motivates the projectile and the reaction mass in opposite directions with the reaction mass eventually being expelled from the pressure vessel.

As with the embodiment of FIG. 2, the reaction mass has a higher velocity than the projectile so that the momentum magnitude of the reaction mass 20 is about equal to the momentum magnitude of the projectile which is launched with the result that the overall weight of the FIG. 3 embodiment is less than that of the above-identified "first recoilless arrangement" while the amount of propellant and backblast are less than in the above-identified "third recoilless arrangement" or "rocket." In addition, as with the embodiment of FIG. 2, the reaction mass 20 may be of particulate or other material to reduce danger from this mass rearwardly of vessel 21.

It can be seen that a device having elements like the previously described elements of FIG. 3 may be fixedly or releasably attached to any object that may be motivated or launched in accordance with the principles of the present invention, so that the object itself serves as a payload.

However, elements such as elements 20-24 may be received in any suitable structure such as a launching tube 25 for guiding projectile 22 during launching. Although not involved in the present invention, this tube may be provided with any suitable sighting or mounting devices and may be adapted for storage and transportation of such elements.

FIG. 4 shows an embodiment advantageously using the above-identified third aspect of the present invention for shoulder launching of a projectile 30. However, it is to be understood that this aspect, or either or both of the above-identified first and second aspects, may be used or for other purposes including launching that is not directly or indirectly related to weapons.

Referring more specifically to FIG. 4, it is seen that projectile 30 is disposed in a typical operating environment, including a launching tube 32 formed by an encasement 33, which is adapted for storage and transportation of the projectile. For launching, it is connected by any suitable quick-connector 35 to a forward tube portion 36, which is provided with a sight 37 and a firing device 39, and thus adapted to guide the projectile 30 during a launch.

Projectile 30 includes a warhead 40 and a pressure vessel 42 extending rearwardly therefrom and provided with a converging-diverging nozzle 43 for acceleration of pressurized gas and of particulate, inert reaction mass material released from a quantity of a composition 45 disposed in a region of the pressure vessel opposite to the nozzle. Accordingly, this region is motivated in a direction opposite to the nozzle so that the inert material is motivated with the pressurized gas through the nozzle and the inert material functions as a reaction mass for recoilless launching of the projectile.

A composition 45, as described above in detail in connection with the second and third aspects of the present invention, includes a propellant and an associated reaction mass material. The reaction mass material is distributed uniformly in the composition so that progressive reaction of the propellant to generate the pressurized propellant gas releases the particulate material at a rate corresponding to the rate of generation of the pressurized gas. Accordingly, the particulate material is entrained in the propellant gas and accelerated thereby in the nozzle oppositely of the warhead and pressure vessel. The nozzle is configured and the propellant selected so that the magnitude of the momentum of the propellant gas and the momentum of the reaction mass is about equal to magnitude of the momentum of the momentum of the warhead and the pressure vessel.

In the practice of the present invention with a projectile having a predetermined weight, as with the warhead 40 and pressure vessel 42 in the embodiment of FIG. 4, the weight of the inert, particulate reaction mass material, such as that in composition 45 may be provided in the pressure vessel in a weight having a range greater than zero and less than this predetermined weight. In an exemplary embodiment, the weight of the inert, particulate reaction mass is in a predetermined range of about one-fourth to about three-fourths of the predetermined weight of the projectile.

Any suitable material 46, including an inert material, such as, in the form of a liquid, may be provided as the reaction mass material 46 in a composition 45. The composition 45 also includes a propellant 47. For compactness in an embodiment such as FIG. 4, it is desirable that this material 46 have a density of at least five times the weight of the propellant 47. Conventional solid propellants, either single base or double base, may be effective with the weight of, for example, the inert material 46 being at least one-half of a total weight of the composition 45.

The reaction mass material 46 may include tungsten, and, in an exemplary embodiment, metallic tungsten, which has a specific gravity of 19.3, is useful in particulate form like that of FIG. 4. Tungsten does not melt and, so, does not adhere to a nozzle such as nozzle 43 when heated by the propellant gas. Tungsten is difficult to ignite and when so heated does not burn on contact with the atmosphere which would increase backblast pressure and flash. Tungsten is generally advantageous as it is not toxic and relatively inexpensive.

As before mentioned, the association of the particles with the propellant may be obtained by dispersing the particles into the propellant when it is in liquid form before solidifying. When particulate tungsten metal is so dispersed, a proportion by weight of particulate tungsten metal in a composition of propellant and reaction mass may be in a range of about 50% to about 90% so that the high proportion of inert material 46 provides an insensitive munition.

In an embodiment of the present invention, to help disperse the reaction mass particles upon exit from a nozzle 43, the nozzle 43 may be configured for under-expansion of propellant gas exiting the nozzle 43. The gas is not expanded completely to atmospheric pressure in the nozzle so that the residual pressure further expands the gas beyond the nozzle spreading the particles as the gas expands.

Relatedly, when a desired sufficient expansion of the propellant gas cannot be obtained because the nozzle exit diameter is limited by the diameter of a projectile, such as projectile 30, the rearward end of the corresponding launching tube 32 may be provided with a diverging nozzle 48 for further expansion of the gas.

FIG. 5 illustrates a structure including two features that may, independently, be advantageous with the second and third aspects of the present invention. The structure includes a high-low combustion or reaction chamber 50 associated with an extended nozzle 51.

Chamber 50 includes a tubular, perforated barrier 55 having a recoilless launching composition 56 disposed on the outer side of the tubular, perforated barrier 55 before generation of propellant gas and release of particulate reaction mass material. The composition is enclosed in a cylindrical pressure vessel 57, which opens at one end to nozzle 51 from tubular, perforated barrier 55 so the propellant gas and the reaction mass particles flow through the perforations (not shown) of the tubular, perforated barrier 55 to the nozzle 51. As a result, and to facilitate the propellant reaction, the propellant reaction pressure may be much higher than the nozzle entrance pressure.

A typical converging-diverging nozzle for acceleration of pressurized gas has proportions approximately those of nozzle 43 in FIG. 4. Similar proportions may be satisfactory for the purposes of the present invention to accelerate particulate tungsten reaction mass material with propellant gas when the particles are of relatively small diameter. However, with relatively larger diameter particles, an extended converging-diverging nozzle, corresponding to nozzle 51 and having a greater length than the length required to accelerate the propellant gas alone, may be effective to accelerate the particles to a velocity providing a desired momentum of the reaction mass.

FIG. 6 depicts a conventional rocket projectile case 70, in which a motor 71 embodies the third aspect of the present invention and resembles the structure shown in FIG. 5.

Case 70 includes a forward warhead portion 75, which includes a fuze section 76, and a rearward motor portion 77, including a propellant region 78 and a nozzle 79. At the motor portion, the case is sufficiently thick to withstand propellant gas pressure from the original about 1.0 lb of propellant which filled region 78 for generation of gaseous reaction mass. Fins 81 are depicted as mounted on the nozzle and, like the warhead portion, function with the present invention as with the original motor.

Motor 71 includes a region 85, which is for a solid propellant and inert particulate tungsten reaction mass composition of the present invention, and has an extended nozzle 86 for accelerating generated propellant gas and released particulates.

With a composition in region 85, the weight of the inert material is much more than one-half the weight of the composition. This weight relationship is similar to that described above in using about 0.3 lb of propellant having a specific gravity of about 1.0 with a dispersed inert reaction mass of 3.7 lb of tungsten particles having a specific gravity of about 19.3. Further, the relative volume of the composition is about 0.3 for the propellant plus about 3.7 divided by 19.3, which is about 0.19, for the inert material for a total relative composition volume of about 0.49. On the same basis, the relative volume of the original 1.0 lb of propellant would be 1.0, so that region 85 can be substantially smaller diametrically than region 78. The nozzle 86 can fit, longitudinally, in nozzle 79.

As a result, recoilless launching in accordance with the present invention with its advantages of greatly reduced backblast hazard, noise, and flash, can be substituted in a existing projectile and launcher with no loss in military effectiveness.

Although the present invention has been herein shown and described in connection with what is conceived as exemplary embodiments, it is recognized that departures may be made therefrom within the scope of the invention, which is not limited to the illustrative details disclosed.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A recoilless projectile, comprising:

a warhead;

a pressure vessel fixed to the warhead, the warhead and pressure vessel having a predetermined weight;

a quantity of recoilless launching composition disposed in the pressure vessel, wherein the recoilless launching composition comprising a propellant reacting progressively to generate pressurized propellant gas in the pressure vessel to accelerate the warhead and the pressure vessel, and wherein the recoilless launching composition comprising a reaction mass comprising particles of an inert material, said particles being distributed uniformly in the recoilless launching composition so that the reaction mass is progressively released from the recoilless launching composition at a rate corresponding to the rate of generation of the propellant gas and the particles are entrained in the propellant gas; and a nozzle being attached to the pressure vessel and configured to accelerate the propellant gas oppositely of the warhead and pressure vessel so that the propellant gas accelerates the reaction mass particles, wherein a first combined magnitude of momentum of the propellant gas and the reaction mass is about equal to a second combined magnitude of momentum of the warhead and the pressure vessel.

2. The recoilless projectile of claim 1, wherein the reaction mass comprises metallic tungsten.

3. The recoilless projectile of claim 1, wherein the particulate material is metallic tungsten, and wherein the propellant is selected from one of a single base propellant and a double base propellant.

4. The recoilless projectile of claim 1, wherein the reaction mass has a predetermined weight range of about one-fourth to about three-fourths of said predetermined weight.

5. The recoilless projectile of claim 1, wherein the nozzle comprises a first length for accelerating the reaction mass to a velocity providing a momentum of the reaction mass, which is greater than a second length required to accelerate the propellant gas alone.

6. The recoilless projectile of claim 1, wherein the pressure vessel comprises a high-low chamber defined by a perforated barrier, wherein the recoilless launching composition is disposed on one side of the perforated barrier before generation of the propellant gas, and wherein the propellant gas and reaction mass particles flow through the perforated barrier to the nozzle.

7. The recoilless projectile of claim 1, wherein the nozzle is configured for under-expansion of the propellant gas exiting the nozzle so that further expansion of the propellant gas beyond the nozzle disperses the reaction mass particles upon exit from the nozzle.

8. The recoilless projectile of claim 1, further comprising a tube for receiving the recoilless projectile for launching.

9. The recoilless projectile of claim 8, wherein the nozzle comprises a limited exit area to prevent a desired expansion of the propellant gas in the recoilless projectile, and wherein said tube is provided rearwardly with a diverging nozzle for further expansion of the gas.

* * * * *